United States Patent [19]

Scheidweiler et al.

[11] Patent Number: 4,582,996

[45] Date of Patent: Apr. 15, 1986

[54] ELECTRODE INSULATING MEMBER FOR IONIZATION FIRE ALARM

[75] Inventors: Andreas Scheidweiler, Jona; Jürg Muggli, Männedorf; Bernhard Durrer, Wilen-Wollerau, all of Switzerland

[73] Assignee: Cerberus AG, Männedorf, Switzerland

[21] Appl. No.: 476,992

[22] Filed: Mar. 21, 1983

[30] Foreign Application Priority Data

Apr. 8, 1982 [CH] Switzerland ..... 2184/82

[51] Int. Cl.[4] ..... H01B 17/32

[52] U.S. Cl. ..... 250/385; 174/209

[58] Field of Search ..... 250/385; 174/209, 178

[56] References Cited

U.S. PATENT DOCUMENTS

| | | | |
|---|---|---|---|
| 3,676,681 | 7/1972 | Kobayashi | 250/384 |
| 3,812,284 | 5/1974 | Pohl | 174/188 |
| 4,190,771 | 2/1980 | Kamei et al. | 250/385 |
| 4,457,589 | 7/1984 | Tamura et al. | 350/336 |

FOREIGN PATENT DOCUMENTS

| | | | |
|---|---|---|---|
| 2015999 | 10/1970 | Fed. Rep. of Germany | 174/209 |
| 506148 | 5/1971 | Switzerland . | |
| 508251 | 7/1971 | Switzerland . | |

*Primary Examiner*—Alfred E. Smith
*Assistant Examiner*—Constantine Hannaher
*Attorney, Agent, or Firm*—Werner W. Kleeman

[57] ABSTRACT

Due to aging of the insulating materials arranged between the electrodes in ionization fire alarms or detectors the insulating efficiency of these thus formed so-called insulating paths or spans deteriorates in the course of time despite, or maybe even due to the cleaning operations performed upon such ionization fire alarms. To ensure that the insulating capacity does not fall below a critical value the insulating path or span is formed by at least two different insulating materials. The materials are arranged in such a manner that the creepage path between the electrodes extends across all the different insulating materials. This principle also may be applied to other measuring devices which require a high input resistance of an amplifier stage.

6 Claims, 2 Drawing Figures

ELECTRODE INSULATING MEMBER FOR IONIZATION FIRE ALARM

BACKGROUND OF THE INVENTION

The present invention relates to a new and improved construction of an ionization fire alarm or detector.

In its more specific aspects the invention relates to a new and improved ionization fire alarm or detector which is of the type which contains a radioactive substance located in an ionization chamber accessible to the ambient atmosphere and two electrodes separated by an insulating member. An electric circuit serves for signalling and triggering an alarm.

In ionization fire alarms or detectors as known, for example, from German Pat. No. 2,130,889 the air present in the ionization chamber which is accessible for the ambient or external atmosphere becomes ionized due to the radioactive substance or specimen located therein. Due to the d.c.-voltage applied to the two electrodes of the ionization chamber an ionic current flows between the electrodes. In the event that smoke, aerosols formed during a fire or other particles enter the ionization chamber through apertures or openings of the chamber then the electric current will change. The electric circuit evaluates the current change such that at a certain reduction in conductivity in the ionization chamber an alarm signal is transmitted to a central signal station via electric lines. In known circuits of such kind the ionization chamber is connected in series with a resistor element which, for example, constitutes a reference ionization chamber which is either very nearly hermetically sealed or insensitive to aerosols formed during a combustion process. The potential difference between the two chambers is determined using a high-ohm or high-impedance amplifier like, for example, a field-effect transistor. Another possibility resides in periodically scanning the charge on the electrodes in the ionization chamber.

Since the ionization chambers generally used have a resistance greater than $10^{10}\Omega$, and thus, the electric circuit must have an input resistance which is substantially higher, the ionization fire alarms or detectors are highly sensitive to any contamination which reduces the electrical resistance i.e., of the insulating member or of the insulating path between the electrodes of the ionization chamber. In the same fashion as aerosols generated by a fire or combustion process other particles emanating from the environment of the detector like, for example, dust are transported into the ionization chamber and will be deposited therein, whereby the electrical resistance of the insulating path will decrease. Consequently, frequent maintenance of fire alarm systems and cleaning of the ionization fire alarms or detectors is required.

According to the aforementioned German Pat. No. 2,130,889 the problem of maintaining the electrical resistance is solved by covering the insulating path or span in the interior of the hood, which serves as the outer or external electrode and contains apertures for the entry of environmental air, by a labyrinth formed by the same highly insulating synthetic material. Thus, the creepage path between the central-electrode and the counterelectrode is protected from contamination, and the creepage path exposed to contamination is enlarged by more than a factor of 4 due to the annular or ring-shaped webs of the labyrinth. It has thus become possible to considerably prolong the period of time until the fire alarm or detector becomes ineffective, i.e. the service or maintenance intervals can be increased. However, synthetic materials, i.e. plastics, are subject to natural aging which may become accelerated due to the action of oxygen in the air or, partially also due to ozone, or due to the action of aggressive ingredients or constituents contained in the environmental air or in the cleaning agents used for servicing the ionization fire alarm or detector. While such corrosive substances are present in standard environmental air only in extremely low concentrations, nonetheless the concentrations thereof may assume considerable values in specific environments. Finally, the duration of the action of the different substances cannot be neglected as well as the fact that the air is ionized by the radioactive source present in the ionization fire alarm, whereby ozone and other compounds or substances capable of attacking the materials of which the ionization fire alarm is composed are formed in the very interior thereof. Since the atmosphere may penetrate between the labyrinth and the insulating path the problem of aging of the insulating path persists.

Cleaning of the ionization fire alarms or detectors during servicing the same did not heretofore present a problem, however, repeated cleanings have always been problematic with respect to maintaining the high surface insulating values of about $10^{10}\Omega$ over longer time spans. The search for materials having sufficiently high resistance towards environmental effects caused by, for example, solvent vapors, insecticides and so forth, did not render a satisfactory result, since it was impossible to find a plastic or synthetic material having optimum properties in respect of all environmental effects.

SUMMARY OF THE INVENTION

Therefore, with the foregoing in mind it is a primary object of the present invention to provide a new and improved ionization fire alarm or detector of the initially mentioned type in which the insulating capacity of the insulating member between the electrodes is maintained for a longer period of time.

Another important object of the present invention is directed to the provision of a new and improved ionization fire alarm which is not associated with the aforementioned limitations and drawbacks of the prior art constructions.

Now in order to implement these and still further objects of the invention, which will become more readily apparent as the description proceeds, the ionization fire alarm of the present development is manifested by the features that, the insulating member or part comprises at least two regions composed of different insulating materials, and these at least two regions are arranged between the two electrodes such that a creepage path extending between the two electrodes extends across all the regions.

According to a preferred embodiment of the ionization fire alarm according to the invention the insulating member comprises three regions composed of different insulating materials. It is particularly preferred that a first one of the three regions is composed of, for example, a polycarbonate, a second of the three regions is composed of, for example, an epoxide resin, and a third one of the three regions is composed of, for example, a polyester.

In a preferred design of the ionization fire alarm according to the invention the one electrode forms a central electrode and the other electrode comprises a hood or cap containing openings or apertures for the entry of environmental or ambient air, the hood defining or delimiting the ionization chamber with respect to the ambient atmosphere for which the same is accessible. The regions composed of different materials are arranged around the central electrode, preferably substantially concentrically.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
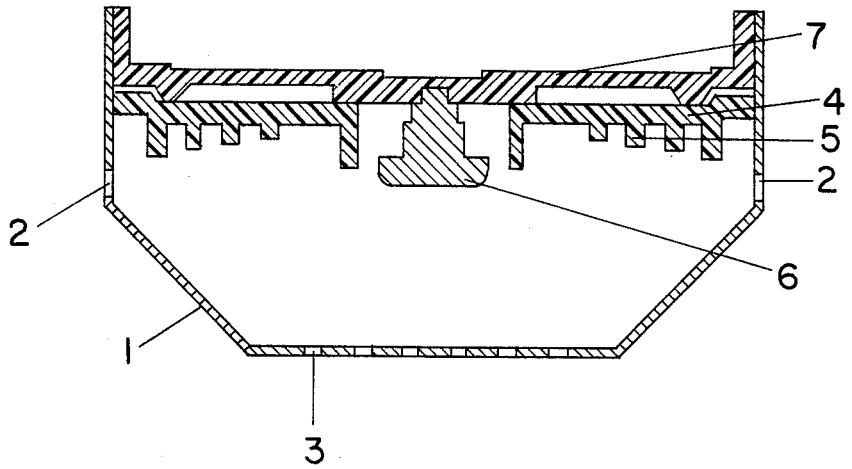
Fig. 1 (Prior Art)
FIG. 1 shows a section through a prior art construction of ionization fire alarm.

Describing now the drawings, it is to be understood that only enough of the construction of the ionization fire detector has been shown as needed for those skilled in the art to readily understand the underlying principles and concepts of the present development, while simplifying the showing of the drawings. Turning attention now specifically to FIG. 1, there has been schematically illustrated in sectional view a prior art ionization fire alarm which comprises a metallic hood or cap 1 containing apertures or openings 2 and 3 for the entry of environmental air. In the interior of the hood 1 there is disposed a labyrinth or labyrinth arrangement 4 made of highly insulating synthetic material, i.e. plastic, which internally contains a number of webs 5 arranged in the form of circular rings for prolonging the creepage path. A substantially slunger or punch-shaped central electrode 6 is located at the center of the labyrinth 4. The outer electrode is formed by the metallic hood 1. The two electrodes 1 and 6 are partially releasably connected to an insulating member 7 by connecting means (not shown). The insulating member 7 and the labyrinth or labyrinth arrangement 4 are made of the same synthetic material, preferably a commercially available polycarbonate, e.g. "Makrolon", available from the well-known German firm Bayer-Leverkusen.

Figure 2:
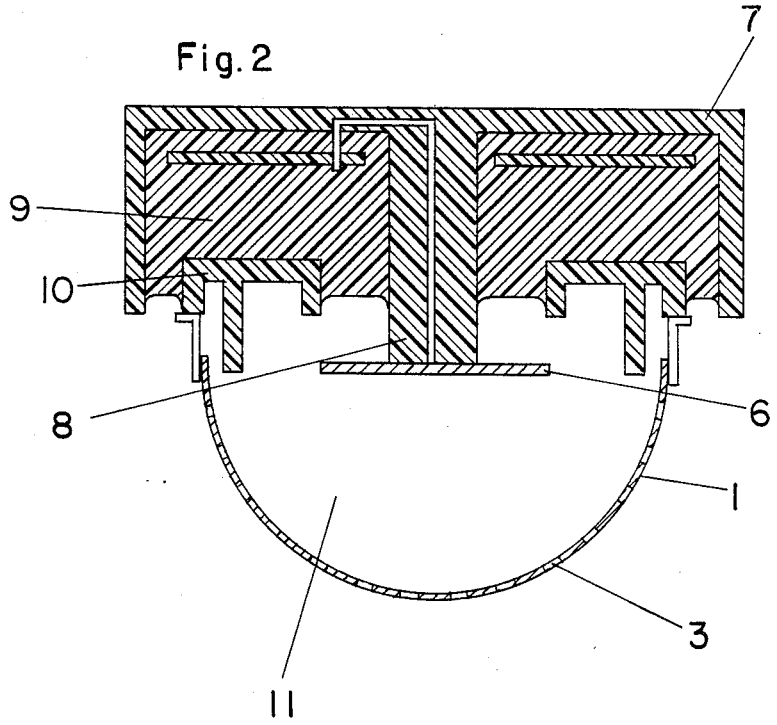
FIG. 2 shows a section through an ionization fire alarm constructed according to the present invention.

In FIG. 2 there is depicted a section through an exemplary embodiment of the ionization fire alarm according to the invention. The ionization fire alarm here also comprises a metallic hood 1 provided with apertures or openings 3 for the entry of environmental or ambient air. The inner counter-electrode 6 which is disposed at the center of the ionization chamber 11, to which the external or ambient atmosphere has access, is located on a central protuberance or elevation formed at the insulating member 7. The insulating member 7 is disposed between the central electrode 6 and the metallic hood 1 forming the other outer electrode and is subdivided to form a first region 8 composed of a polycarbonate, a second region 9 composed of an epoxide resin, and a third region 10 composed of a polyester.

With such arrangement there is achieved the beneficial result that a creepage current forming between the central electrode 6 and the metallic hood 1 forming the outer or external electrode is conducted across three insulating paths or spans formed by different synthetic materials. The material from which the first region 8 is composed may be thermoplastic polyesters, i.e. polycondensates derived from carbonic acid and diols. Such polycarbonates are resistant to water, neutral salt solutions, mineral acids including, for example hydrofluoric acid, aqueous solutions of oxidants, hydrocarbons, oils, lipids and others. Specifically, this region of the insulating path is produced from a commercially available polycarbonate, available under the trademark "Makrolon", from the well-known German firm, Bayer-Leverkusen. The second region 9 is preferably made of a thermosetting plastic material derived from epoxides and polyols. The electronic components of the ionization fire alarm may be embedded into the casting mass formed by the epoxide resin. The epoxide resins are resistant to atmospheric effects or agents, water, acids, bases, oil, gas, benzene, benzol and others. The third region 10 is preferably produced from a polycondensate formed by multivalent alcohols (diols, polyols) and multibasic carboxylic acids. Such polyesters are resistant towards all organic solvents. They are however, less resistant to water and alkali as well as to acids above 70° C. To improve the insulating capacity of the insulating member 7 one or more of the different regions 8, 9, 10 may be provided with annular protuberances or elevations to prolong the creepage path, without the process of manufacturing the insulating member 7 becoming appreciably more complicated.

An essential advantage of the ionization fire alarm according to the invention is that the insulating capacity of the insulating member 7 is retained over substantially longer periods of time as compared to known ionization fire alarms or detectors. If the surface resistance of one of the synthetic materials forming the insulating member 7 is reduced by the action of aggressive ingredients or substances from the atmosphere or by even the least damage due to the action of cleaning or drying agents, the insulating capacity of at least one of the other regions is still preserved due to the different chemical compositions of the individual regions. When preparing instructions for the technological procedure for cleaning the plastic parts, the chemical nature thereof is extensively taken into consideration. However, the composition of the dust deposited upon the insulating path is not known, so that frequently reactive cleaning agents like, for example, a surfactant-containing laboratory cleaning solution such as RBS (available from Carl Roth, GmbH & Co., KG, 75 Karlsruhe 21, The Federal Republic of Germany) must be used. To enable rational servicing of ionization fire alarms the members thereof have to be dried after cleaning by using water-displacing agents like isopropanol or freon. Preservation of the surface properties or nature of the plastics members, therefore, can not be ensured in the long run. When, however, the individual regions in the insulating member 7 are made of plastics having different chemical resistivity, then the danger of the insulating capacity of the entire insulating member 7 decreasing below an acceptable limit or threshold is considerably reduced in comparison to the known ionization fire alarms or detectors.

It will be self-evident that other plastics materials can be used in place of the employed synthetic materials mentioned hereinbefore provided that it is noted that the resistance of the synthetic materials against external effects is as different as possible. One of the important inventive concepts, namely, increasing the resistivity or resistance of the insulating paths by subdividing the same into regions of different chemical compositions has been described hereinbefore with reference to an ionization fire alarm. Still, the insulating paths of other fire alarms or detectors requiring a high input resistance of an amplifier stage can be significantly improved by series arranging regions made of different plastics materials while the insulating paths are manufactured.

While there are shown and described present preferred embodiments of the invention, it is to be distinctly understood that the invention is not limited thereto, but may be otherwise variously embodied and practiced within the scope of the following claims.

Accordingly, what we claim is:

1. An ionization fire alarm comprising:

an ionization chamber accessible for ambient atmosphere;

two electrodes provided for said ionization chamber;

an insulating member separating said two electrodes;

said insulating member comprising at least two regions composed of different insulating materials;

one insulating material of said different insulating materials being disposed intermediate a first one of said two electrodes and another insulating material of said different insulating materials;

said one insulating material having first properties of electrical resistance to surface creepage current;

said another insulating material having second properties of electrical resistance to surface creepage current which differ from said first properties of electrical resistance to surface creepage current; and said at least two regions being arranged between said two electrodes such that a surface creepage path between said two electrodes extends across all said regions.

2. The ionization fire alarm as defined in claim 1, wherein:

said insulating member comprises three regions composed of different insulating materials.

3. The ionization fire alarm as defined in claim 2, wherein:

a first one of said three regions is composed of a polycarbonate, a second one of said three regions is composed of an epoxide resin and a third one of said three regions is composed of a polyester.

4. The ionization fire alarm as defined in claim 1, wherein:

said first one of said two electrodes forms a central electrode;

a second one of said two electrodes forms a hood provided with apertures for the entry of the ambient atmosphere;

said hood delimiting said ionization chamber relative to the ambient atmosphere; and said regions of said different insulating materials of said insulating member are arranged around said central electrode.

5. The ionization fire alarm as defined in claim 4, wherein:

said regions of said different insulating materials are arranged substantially concentrically around said central electrode.

6. An insulating member for the electrodes of an ionization chamber of a fire detector, comprising:

a first region surrounding a first one of the electrodes;

at least one further region surrounding said first region;

said first region and said at least one further region being disposed intermediate said first one of the electrodes and at least one further one of the electrodes;

said first region comprising an insulating material having properties of electrical resistance to surface creepage current; and said at least one further region comprising a different insulating material having properties of electrical resistance to surface creepage current which are different from said properties of electrical resistance to surface creepage current of said insulating material of said first region.

* * * * *